US010814242B1

(12) United States Patent
Hampton et al.

(10) Patent No.: US 10,814,242 B1
(45) **Date of Patent: *Oct. 27, 2020**

(54) TOY WITH BUILD-TIME EFFECTS

(71) Applicant: DISNEY ENTERPRISES, INC., Burbank, CA (US)

(72) Inventors: John C. Hampton, Orlando, FL (US); Alex Christopher Wilde, Orlando, FL (US)

(73) Assignee: Disney Enterprises, Inc., Burbank, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 16/659,767

(22) Filed: Oct. 22, 2019

Related U.S. Application Data

(63) Continuation of application No. 16/251,839, filed on Jan. 18, 2019, now Pat. No. 10,486,078.

(51) Int. Cl.
*A63H 33/26* (2006.01)
*A63H 33/22* (2006.01)
*A63H 5/00* (2006.01)

(52) U.S. Cl.
CPC ..... *A63H 33/26* (2013.01); *A63H 5/00* (2013.01); *A63H 33/22* (2013.01); *A63H 2200/00* (2013.01)

(58) Field of Classification Search
CPC .... A63H 2200/00; A63H 3/28; A63H 33/042; A63H 5/00; G06K 7/10366; A63G 33/26
See application file for complete search history.

(56) References Cited

U.S. PATENT DOCUMENTS 5,346,418 A * 9/1994 Arad ..... A63H 5/04 446/405
2005/0215170 A1* 9/2005 Poesch ..... A63H 3/48 446/297
2011/0143631 A1* 6/2011 Lipman ..... A63H 3/28 446/175
2014/0179446 A1* 6/2014 Zuniga ..... A63F 13/98 463/47
2017/0157522 A1* 6/2017 Chen ..... A63H 3/50

* cited by examiner

*Primary Examiner* — Michael D Dennis
(74) *Attorney, Agent, or Firm* — Snell & Wilmer L.L.P.; Kent A. Lembke

(57) ABSTRACT

A design for build-your-own (BYO) toys in which each build participant is provided a toy body or base part and asked to select a data key for their toy. The key has associated with it a set of build-time functions or special effects as well as post build-time functions. The toy body includes a controller that is operable to sense or detect when the key is properly installed or attached to the toy body (e.g., in a key receptacle or interface) and, in response, to read an identifier (ID) (e.g., a static code as may be provided in an RFID tag/chip). The controller may then operate onboard functional elements such as lights and a sound system to provide functions or special effects linked to that key's ID. Each key type may have different special effects associated with it for use during build time and during post build time.

18 Claims, 13 Drawing Sheets

CONTINUED ON FIG.10B
*** Provide stable light intensity [ 4.5V - 3.3V]
and longest the battery ***
Vbat
3x V4
C32
8.1UF
C31
2.2UF
0603
R54
10K
R64
47K
U2
TPS61
SW
VIN
RUN
GND
FB
GND
L1
2U2
R52
TBA
R53
TBA
C29
10UF
0603
C33
8.1UF
3V3
Q13
MMBT5550HLT1-UTL (SOT-23)
R103
1K
IO87
Q12
MMBT5550HLT1-UTL (SOT-23)
R89
1K
Q4
MMBT5550HLT1-UTL (SOT-23)
R88
1K
Q3
MMBT5550HLT1-UTL (SOT-23)
320mA
R86
1K
IO86
IO85
IO84
A OP4
B OP3
C OP2
D OP1
PL1

TOY WITH BUILD-TIME EFFECTS

CROSS REFERENCE TO RELATED APPLICATIONS

This application is a continuation of U.S. patent application Ser. No. 16/251,839, filed Jan. 18, 2019, which is incorporated herein by reference in its entirety.

BACKGROUND

1. Field of the Description

The present description relates, in general, to toys designed to be assembled or built. More particularly, the present description relates to a new toy design that has one set of functions or associated special effects during assembly or at build time and another set of functions or associated special effects after successful or proper assembly.

2. Relevant Background

There are many environments where it is desirable to provide interactive experiences for a group of people. For example, build-it yourself experiences have recently been growing in popularity. Numerous businesses have created build your own (BYO) experiences in which participants can make their own toy that is personalized by allowing them to choose among differing toy components and by allowing the participants to accessorize their toy.

To date, these BYO toy experiences have been successful in meeting the goal of creating a finished product that the participants find unique because they designed and built it themselves. Unfortunately, the building experience itself is often relatively dull, and its success may rely heavily upon the skill and experience of the leader of the BYO toy experience. Hence, there remains a demand for BYO toy experiences that are more enjoyable and in which the assembly process itself is perceived by the participants as unique and exciting.

SUMMARY

The inventors recognized that through toy design and through scripting and planning of the building experience that build your own (BYO) toy experiences can be significantly improved to be more enjoyable and memorable. In brief, the inventors created a new design for BYO toys in which each build participant is provided a toy body or base part and asked to select a data key or, more simply, key for their toy. The key has associated with it a set of build-time functions or special effects as well as post build-time functions.

The toy body includes a controller that is operable to sense or detect when the key is installed or attached to the toy body (e.g., in a key receptacle), whether it is installed correctly or incorrectly, and to read an identifier (ID) (e.g., a static code as may be provided in an RFID tag/chip). The controller may then operate onboard functional elements such as lights and a sound system to provide functions or special effects linked to that key's ID (e.g., each key type may have different special effects associated with it for use during build time and during post build time). These build-time effects may include playing a sound file indicating the toy being built is powering up and to illuminate the key and/or portions of the toy body or its surroundings with one or more colors of light tied to the key chosen by the participant. In some cases, the key will include embedded memory that can be read to facilitate these functions such as to play a sound file or soundtrack during build time or post build time.

In addition to the key, the new toy design provides one or more sets of add-on components or accessories that each may include one, two, three, or more items that can be chosen by the participant to individualize their BYO toy or to have the BYO toy better match equipment used by their favorite movie or comic book character. The participants may then build or assemble their BYO toy by assembling or attaching the chosen add-on components or accessories to the toy body or base part. The controller in the toy body includes a sensor or detector for detecting when assembly is completed such as when a last add-on component is properly coupled to the toy body. In response, the controller may operate the functional elements in the toy body to halt build-time functions or special effects. The participant may then use a switch or other user input device on the body or base part to cause the controller of the now assembled BYO toy to operate the functional elements, such as lights, a sound system, and the like, to provide post build-time functions or special effects (which typically differ at least in part from the build-time functions or special effects).

More particularly, a toy is provided that is adapted for a build-it yourself experience that includes build-time effects. The toy includes a base part, a controller provided in a body of the base part, and a functional element on or in the body of the base part. The toy further includes a data key for the toy having configuration data stored thereon (e.g., an ID value of an RFID chip or readable code with toy data/information), and a set of add-on parts configured to be assembled with the base part. The controller includes a data key sensor that senses when the key is inserted into or attached onto the body of the base part (such as in a data key receptacle or slot in the body) and that retrieves the stored configuration data. The controller, in response to the data key sensor sensing the data key has been inserted or attached and in response to retrieving the configuration data, first operates the functional element to perform a build-time function. Further, the controller includes an assembly sensor sensing completion of assembly of the set of add-on parts with the base part, and, in response to the sensing of the completion of assembly, the controller second operates the functional element to halt the build-time function.

In some embodiments, the build-time function is selected by the controller from a plurality of build-time functions based on an identification of the data key. The identification of the data key may be stored in a set of readable, static code on the data key, and the controller includes a reader adapted for reading the readable, static code. For example, the key may include an RFID tag including or storing the readable code (static code, dynamic code, and/or programmable code and/or data), and the controller may include an RFID reader for reading the RFID tag. In some cases, the functional element is a lighting assembly, and the plurality of build-time functions includes outputting light in a plurality of colors. The build-time function then is one of the plurality of colors. The lighting assembly may be configured to illuminate the key with the one of the plurality of colors while operating to provide the build-time function. In the same or other cases, the functional element may be a sound system, and the plurality of build-time functions includes playing a sound file over a speaker on the body of the base part, with the sound file being provided on data storage on the data key or being selected by the controller from memory on the body of the base part based on the identification of the data key.

In some preferred embodiments, the build-time function is performed in a manner that is responsive to sensing of the degree of completion of assembly. In such embodiments, the controller operates the functional element or a functional element in one or more of the add-on parts or in an additional add-on part attached after the sensing of the completion of assembly to perform a post build-time function that differs from the build-time function. Further, the body of the base part often will include a user input device (such as a switch), and the controller is configured to initiate the post build-time function in response to sensing input from a user of the toy via the user input device.

DETAILED DESCRIPTION

Figure 1:
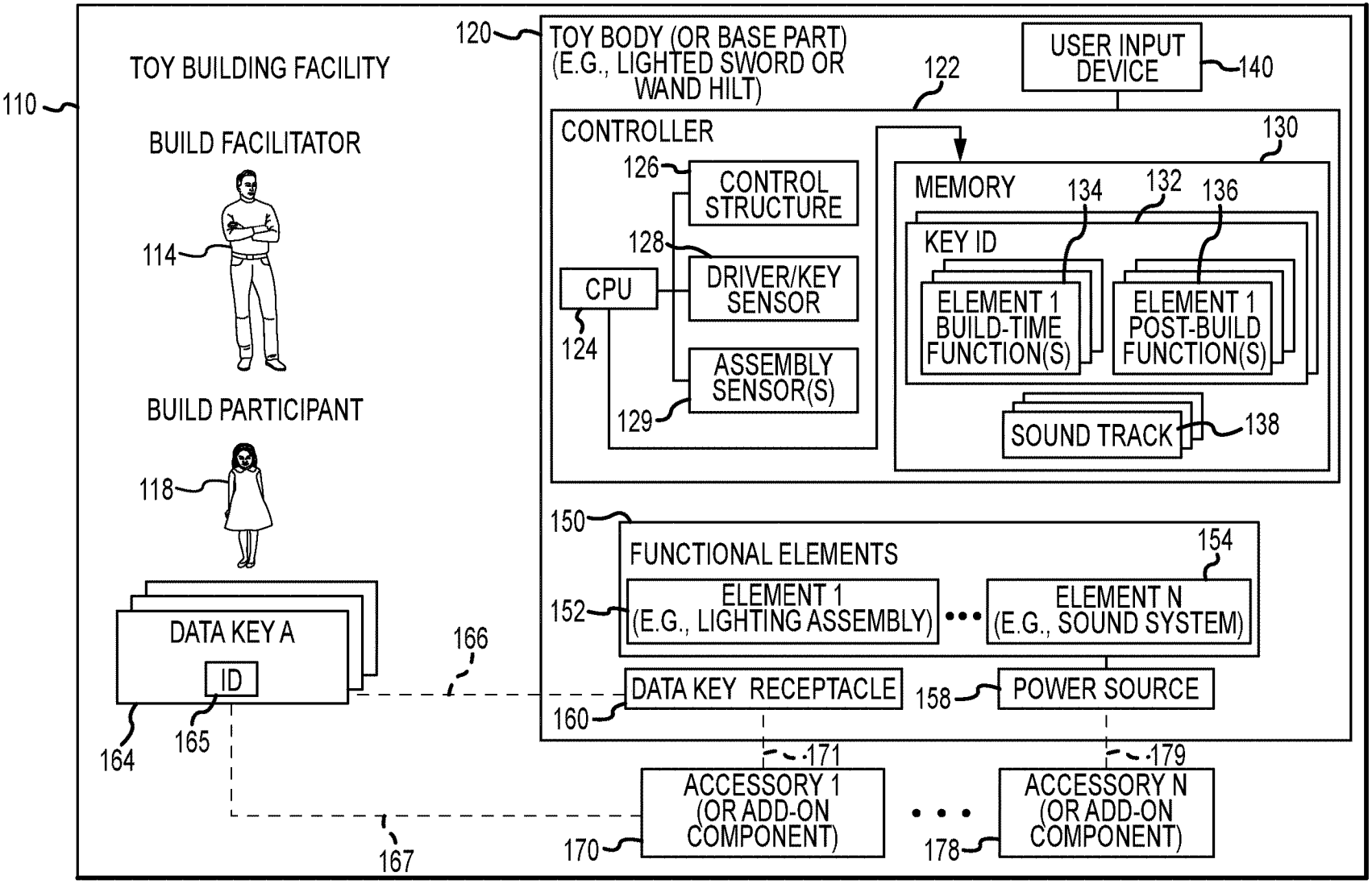
FIG. 1 is a schematic or functional block drawing a toy building process of the present description that may occur at a toy building space or facility.

The following description is directed toward methods for creating a build your own (BYO) toy experience and toward designs for the BYO toy and for the BYO facility/environment. Participants select a data key (or, more simply, "key") for their BYO toy that will be attached to or inserted into a universal toy body or base part. There may be two or more keys to choose from and each will be associated with a set of build-time functions or special effects as well as a set of post build-time functions or special effects. Often, the build-time and post build-time effects will differ for each key and also among the different keys. The build-time and post-build-time effects may be additive (e.g., two installed keys cause two individual effects) or combinatorial (e.g., two installed keys cause effects that are distinct from and in addition to the individual effects). The toy body or base part contains a controller with a sensor or detector for determining when the key is inserted and/or whether it is properly inserted (e.g., into a key receptacle or slot), for determining the ID of the key (or its type), and, in response, for operating one or more onboard functional elements to provide build-time effects or functions.

As part of the BYO toy experience, the participant may also be provided a plurality of add-on parts or accessories that they can select (or two or more sets of such add-on parts) for use in building and individualizing their BYO toy. The facilitator may assist the participants in completing assembly of their BYO toy with the add-on components they choose. The BYO facility or environment may include trays, tables, walls, and so on that also provide build-time effects such as when the key is positioned in a particular spot that activates lighting or sound systems to operate in a manner matched to the key. Also, portions of the facility such as a build table may include a top that can be opened or moved to reveal additional components that can be attached or coupled to the toy body or base part.

The controller typically will include a sensor or detector for sensing when individual steps in the assembly process or the assembly itself is properly completed such as when a final add-on part is attached to or coupled with the toy body or base part. Similarly, the sensor may sense and generate a signal indicating improper assembly. In response, the controller may alter or halt operations of the functional elements (e.g., to turn off lights, to turn off a sound system or play another sound file, and so on). Then, the controller may await input from the participant via a user input device (e.g., a switch, a button, a touchscreen, a joystick, a sound activated system, and/or the like) that turns the assembled BYO toy to an on or active mode, and, in response to such input, the controller may operate the assembled BYO toy to cause the functional elements to provide post build-time functions or effects (e.g., to provide particular lighting, to playback particular sound files, and the like). As with the build-time effects, the post build-time effects are typically matched to the particular data key chosen by the participant and inserted into or attached to the toy body and typically differ at least partially from other ones of the keys.

One useful example discussed below is that of a BYO toy that allows build participants to assemble their own wand or wand-type toy. In one envisioned BYO experience, some effects (e.g., light emitting diodes) in a toy body or hilt are turned on or active (and off, in some cases) only during build time and only upon insertion of the key that is a physical token that embodies machine readable data where the machine readable data indicates, in the examples herein, a theme or character identity. The key can take any physical form suitable for a particular application such as cube, cylinder, sphere, or irregular shapes such as a crystal, jewel, or puzzle piece. The key may be any color, be opaque, be translucent, or be a mixture of these. For example, when a data key is properly inserted into a hilt's receptacle or slot, a light is activated by a controller to externally light the data key to make the data key (with a transparent or translucent body) glow with a color specific to the data stored with the data key that was read by a sensor (such as an RFID reader) on/in the hilt and processed by the controller. This not only makes the build experience more interesting for the participant, but it guides the participant because improper assembly will either not activate the effect or, in some embodiments, activates an alternative "error message" (e.g., the controller's sensor fails to detect proper insertion). When the BYO toy assembly is complete, these build-time effects are disabled, which saves power as may be desirable because some effects may no longer be visible (e.g., a sleeve and/or a switch may be slid over the glowing data key in its receptacle in the hilt) and which differentiates build-time from post build-time functionality of the BYO toy.

FIG. 1 illustrates a toy building process that may occur with a new toy design of the present description. As shown, the toy building process may occur in a space such as in a toy building facility 110, and it may be led or directed by a build facilitator or leader 114. One or, more typically, two or more build participants 118 will be guided by the build facilitator 114 in how to assemble and/or build their own toy that they can design or individualize to suit their preferences or to have desired functions or special effects. The facilitated BYO experience described in connection with FIG. 1 is only one example in that features of the present invention will also improve the build experience of unfacilitated assembly at home of toys, models, kits for toys and furniture, and the like.

Each participant 118 may be provided a toy body or base part 120 by the facilitator 114, and these typically will all be identical or similar. For example, the building process may have the goal of building a roleplay toy such as a lighted sword or wand, and the base part 120 may take the form of a hilt or handle for the lighted sword or wand. The toy body or base part 120 includes a controller or control assembly 122 with a processor 124 executing code/instructions in local memory 130 to provide a control application 126 to control build-time and post build-time functions of the toy including the body/part 120.

Also, the memory 130 is shown to store a file 132 for each key 164 that may be inserted or attached to the body/base part 120 (e.g., inserted into a key receptacle 160 provided in the body 120). Each of these files 132 is linked to one of the identifiers (IDs) 165 of the keys 164, and each file 132 includes a set of build-time function definitions 134 for one or more functional elements 150 provided in or on the body/base part 120. Each file 132 also includes for one or more of the functional elements 150 a set of post-build time function definitions 136, and these will typically differ at least partially from the build-time function definitions so that operations or special effects provided by the toy with the toy body 120 differ after successful assembly.

The toy body 120 also includes a power source 158, such as a battery or electrical circuit to support plugging into an electric socket, providing power as shown to the functional elements 150. A wide variety of functional elements 150 may be provided as shown with element 152 that may take the form of a lighting assembly (e.g., one, two, three, or more light emitting diodes (LEDs) such as red, green, and blue LEDs) and with element 154 that may take the form of a sound system (e.g., system with one or more speakers provided on the body 120). The sound system or another system may be configured to provide vibration, haptic feedback, fans/blowers, motors, scent outputs, and the like to further the functional aspects of the toy body 120 and its use. The memory 130 may store one or more soundtracks or sound clips 138 (or files to drive the other optionally included components of the sound system noted above) that can be played over the sound system 154, with the same or differing ones provided during build-time as defined at 134 for each key 164 in file 132 and during post build-time as defined at 136 for each key 164 in file 132. Likewise, the function definitions for build-time 134 and for post build-time 136 may include how to operate the lighting assembly 152, which may differ between build-time and post build time and may differ for each key 164 (e.g., steady or blinking lights, specific colors for each key 164, and so on).

The toy body or base part 120 also includes a data key sensor (or detector) 128 whose output is processed by the control application 126 to determine when a key 164 is inserted into (or attached onto) the data key receptacle 160 and, when detected, to determine the key ID 165. For example, the facilitator 114 may request each participant 118 to select one key 164 from a set of two or more keys 165 and to then insert/attach as shown with dashed line 166 the selected key 164 into the key receptacle 160 on the toy body or base part 120. Proper insertion or attachment (e.g., right side up, full insertion/attachment) is detected and then the sensor 128 determines which type of key 164 was inserted/attached by determining the ID/value 165 (e.g., a code element with readable, static code). In one embodiment, the ID element 165 is an embedded device in or on the body of the key 164 such as an RFID chip, and the sensor 128 includes an RFID reader that is operated upon detection of proper insertion or attachment of the key 164 in the receptacle 160.

The control application 122 may use this key identification to retrieve or access one of the files 132 linked to that type of key 164 to determine a set of build-time functions/special effects 134 to provide via operation of the elements 152 and/or 154 of functional elements 150. For example, a particular color and brightness of light may be provided by a first functional element 152 while concurrently a sound (e.g., humming indicating powering up or on) defined by a soundtrack 138 and identified in the build-time functions 134 may be played by operation of the second functional element 154. In other embodiments, the key 164 includes memory, and the memory may include the sound files 138 and/or the file 132 such that the controller 122 can read this data from the key 164 rather than from its onboard memory 130. In some embodiments, the keys 164 have a color, and the light assembly 152 is operated to output light color with a matching or complementing the color of this outer surface.

These operations of the functional elements 150 are build-time functions or special effects that typically are initiated upon selection of and insertion/attachment of the key 164 and are terminated upon successful completion of the building or assembling of the toy. After assembly, a different set of functions/special effects as defined at 136 in file 132 may be provided by the controller's operation of the functional elements 150, and this new operation may be triggered by the build being completed and/or by the build participant 118 operating a user input device 140 (e.g., an on/off button or switch, a trigger, and so on). As with the build-time functions 134, the post build-time functions 136 often are specific to the type of key 164 chosen by the participant 118, and the participant 118 may be informed by the facilitator 114 or otherwise of the functions 136 associated with (or provided by) each key (as well as the build-time functions 134 for each key 164). Prior to full assembly/building, operation of the user input device 140 typically will not cause the controller 122 to provide the post build-time functions 136 (e.g., these are only available after successful assembly of the toy).

In addition to selection of a key 164, the participant 114 may be provided a set of one, two, or more accessories or add-on components 170, 178. These may be separately selectable by the participant and/or may be linked or tied as shown with dashed line 167 to the key 164. As shown with dashed lines 171 and 179, the participant 118 builds or assembles the toy by attaching or otherwise assembling (e.g., inserting, screwing on, snapping on or into recesses on body 120, and the like) the accessories 170, 178 to the body 120. This building or assembling process may be guided by the facilitator 114 and/or with posted or provided instructions, and the accessories 170, 178 may have to be attached in a particular order to the body 120 to successfully build the toy with the toy body 120.

Figure 2:
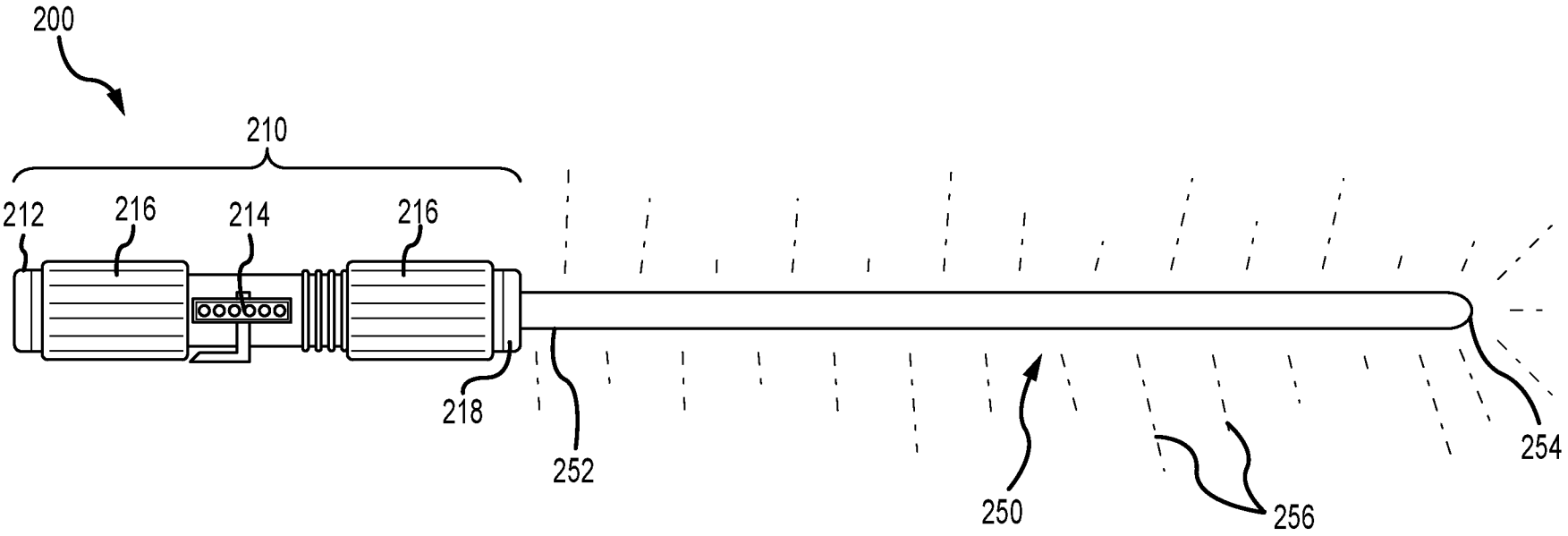
FIG. 2 is a side perspective view of an assembled and operating toy of the present description that may be implemented via process shown in FIG. 1.

The controller 122 is shown to include an assembly sensor(s) 129 that functions to sense or detect when all (or the last in some cases) of the accessories 170, 178 have been attached to or assembled upon/in the body 120 in a predefined manner (e.g., fully inserted, properly oriented relative to the body 120, and so on). In a particular implementation, sensor 129 includes a magnetic field sensor (e.g., a Hall effect sensor) or electrical continuity sensor that produces a signal when a final component such as switch 214 described in conjunction with FIG. 2 is installed indicating assembly completion. The control application 126 processes output of the sensor/detector 129 (e.g., a magnet sensor, a continuity sensor, or other useful type of device for detecting/sensing completion of assembly or presence of a part/component in a proper location/orientation), and, upon completion of assembly, the controller 122 may terminate operation of the functional elements 150 using the build-time function definitions 134. The controller 122 may then automatically begin to operate the functional elements 150 using post build-time function definitions 136 or may allow these to be triggered by the participant via operation of the user input device (e.g., provide user input such as pressing a button, flipping a switch, pulling a trigger, moving a joystick, pressing a portion of a touchscreen, or the like).

In some embodiments, one or more of the accessories/add-on components 170, 178 is attached to the toy body 120 by interaction with equipment in the facility 110. For example, the toy may be a light sword or wand, and the facilitator 114 may instruct the participant to position the toy body 120 (with or without other accessories 170, 178 already assembled to the body 120) into a recessed surface on a table or wall in which the one or more accessories/add-on components 170, 178 are located and to take some addition action (e.g., rotate the body clockwise one turn) to assemble this component 170, 178 onto the body 120. The facilitator 114 may then instruct all of the participants 118 to operate the user input device 140 to initiate its post build-time functions 136 and to withdraw the body 120 from the recessed surface/receptacle to provide a reveal of the completed toy with the addition of the new add-on component (e.g., a now illuminated component of the toy having a color set by the choice of the key 164 by the participant 118).

With the BYO toy process and BYO toy design of FIG. 1 understood, it may be useful to provide one specific example of a toy that may be built using the ideas taught herein. FIG. 2 illustrates an assembled BYO toy 200 configured according to the present description (and as may be assembled as discussed with regard to FIG. 1). The toy 200 includes a hilt or handle assembly 210 to which is affixed a lighted component 250.

While not shown in FIG. 2, the hilt or handle assembly 210 includes a center hilt or toy body to which one-to-many add-on parts or accessories are coupled along with the light blade. The light blade 250 is shown to be attached at a first end 252 to the emitter end of the hilt assembly 210 and to extend some distance or length outward to a second end 254 distal to the hilt assembly 210. The controller in the hilt assembly 210 (as discussed with reference to FIG. 1) operates to cause light sources provided in the light blade 250 to output light 256 along its length (from end 252 to end 254) and, typically, in a color determined by the data on the key.

In some embodiments, the light blade 250 may be provided in a variety of lengths such as lengths in the range of 29 to 34 inches or the like, while build experiences may often use a single length for all to simplify the build process. To allow assembly of the BYO toy, a common design for the lighted component 250 may be chosen that can be used interchangeably with all hilt assemblies 210 that may be assembled with the common center hilt design and the vast array of possible combinations of add-on parts and/or accessories.

In one embodiment, the light blade 250 includes an RGB LED light strip inside the blade body that extends between ends 252 and 254 (such as 20 to 80 spaced-apart RGB LEDs on the strip that are operable individually and as a unit). Each RGB LED has a color selection ability to emit a spectrum of colors in light 256 by mixing intensity of red, green, and blue LEDs in the strip so that the controller in the hilt assembly 210 may operate the light strip to output light 256 in a color and intensity chosen based on the data on a data key inserted into or attached to the center hilt. Conductive contacts at the end 252 are used to transfer power from the hilt assembly 210 to the blade 250. The LEDs on the light strip may be turned on in a coordinated fashion to provide a chasing effect or other animation from the bottom or inner end 252 to the top or outer end 254 (and the rate of this animation may be determined by the inserted key such as to match a particular sound file), and the LEDs may be turned off in opposite chasing effect form end 254 to end 252 (such as in response to the user/participant pressing the switch or other user input device).

The hilt assembly 210 may include and be built upon the center hilt (or toy body or base part) 300, which would be the same used for each BYO toy 200 that may be assembled by a participant in a toy build experience. The center hilt 300 includes a tubular (or cylindrical) and elongated body 310 that extends some length from an outer or first end 312 to an inner or second end 313. Between these ends 312, 313, the hilt body 310 includes a receptacle (or key receptacle or slot) 314 that is adapted for receiving any of a number of keys that participants are allowed to choose when building their BYO toy 200. In some preferred embodiments, the receptacle 314 is configured to only allow insertion of the key when it is oriented in a predefined or "proper" manner (e.g., one end proximate to hilt end 312 and a second end proximate to hilt end 313) to facilitate successful assembly of the BYO toy 200 by all participants.

As shown in FIG. 2, the hilt assembly 210 further includes the following add-on parts or accessories that have been attached or coupled with the body 310 (e.g., its outer surfaces) of the inner hilt 300: (a) an end cap 212; (b) a switch 214 (that may include a user input device for interacting with the controller inside the hilt body 310); (c) a pair of sleeves 216 in between which the switch 214 is sandwiched; and (d) an emitter 218 for the light blade or lighted component 250. Typically, a build participant will have the opportunity to select among two or more of each of these accessories 212, 214, 216, and 218 in creating their BYO toy 200, while in some instance subsets of all available accessories are grouped for selection based on the key chosen by the participant. For example, the participant may choose a key suited to a particular set of characters and the accessories 212, 214, 216, and 218 may be reduced to sets that would allow the participant to build a BYO toy that typically would be used by one of those characters from a science fiction or fantasy story or movie.

Figure 3:
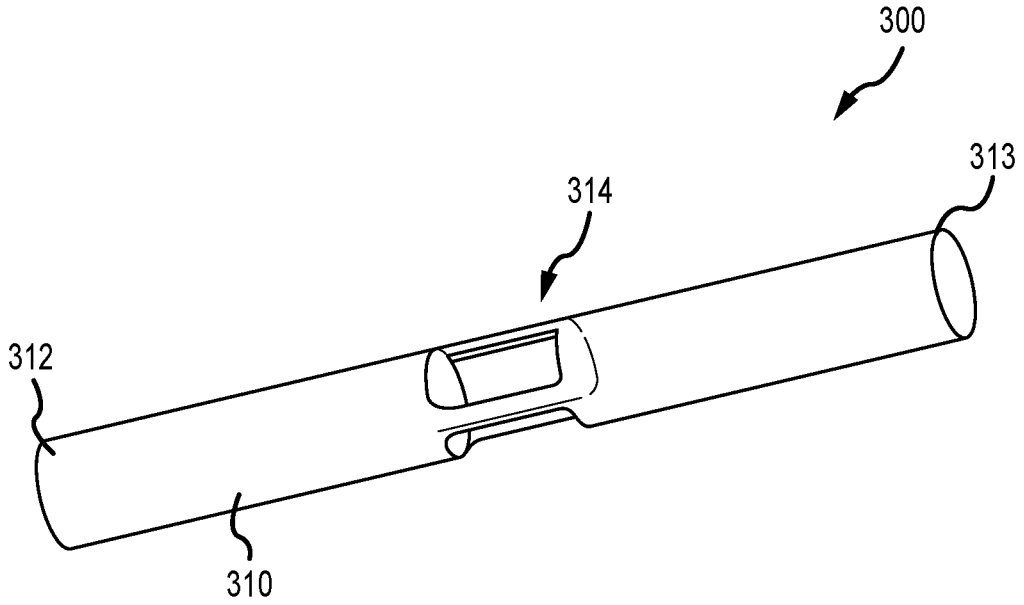
FIG. 3 is a perspective view of an exemplary hilt or base part for use in a BYO toy of FIG. 2.
Figure 4:
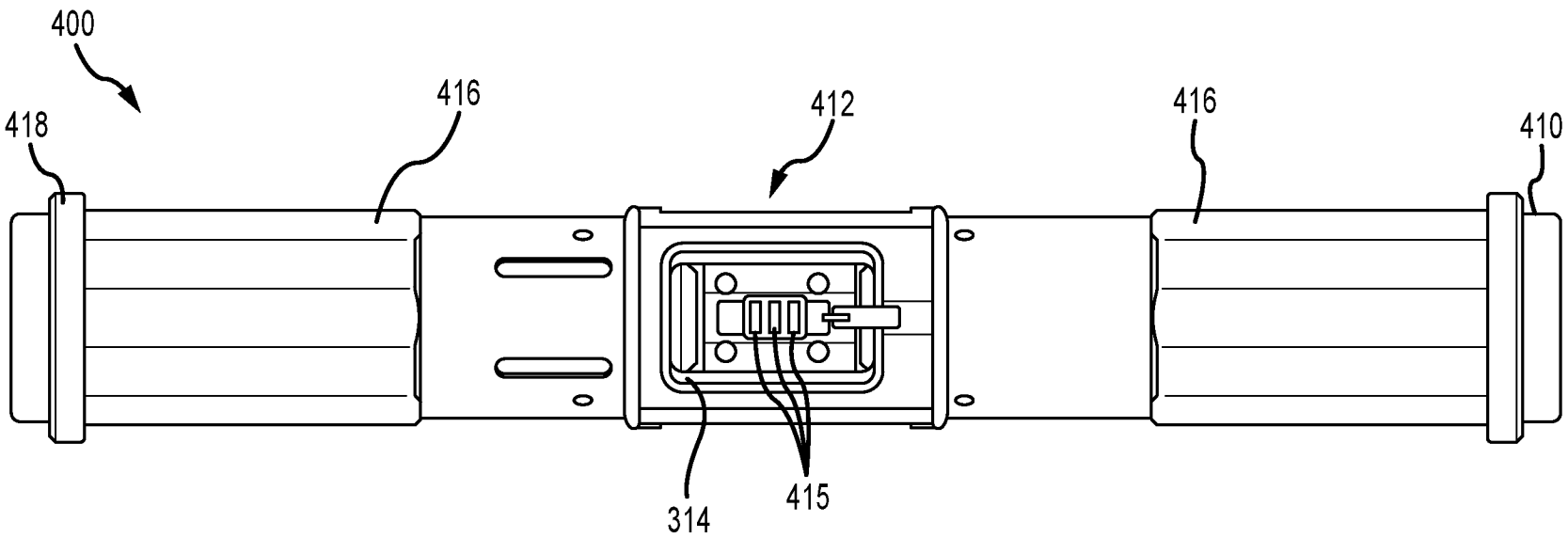
FIG. 4 illustrates a side view of a partially assembled hilt/handle assembly of a BYO toy including the inner hilt or base part of FIG. 3 prior to insertion of a key into the hilt's data key receptacle or slot.

FIG. 4 illustrates another hilt assembly 400 that may be built upon the center hilt 300 of FIG. 3. The hilt assembly 400 differs from assembly 210 of FIG. 2 as it includes a set of accessories with a different design (e.g., look and feel) but similar size, shape, and function (including assembly method with the exterior surfaces of the hilt body 310). As shown, the hilt assembly 400 includes an end cap 410, a pair of sleeves 416 slid onto the body 310 of the hilt 300, a switch 412 sandwiched between the sleeves 416, and an emitter 418. The end cap 410 and the emitter 418 retain the sleeves 416 and switch 412 in desired positions along the length of the body 310 of the hilt 300 (e.g., a threaded connection or the like).

FIG. 4 is useful for showing additional details of the receptacle 314 of the hilt body 310. The switch 412 is shown with a portion of its cylindrical, hollow body cut away or removed to reveal the interior portion of the receptacle 314. The interior portion or space of the receptacle 314 is configured for receiving a key of a particular size (including outer diameter/dimensions and length) and shape, and the insertion of the key into the receptacle 314 may be detected by a sensor(s) of the controller in the hilt body 310 such as by having an end of the key forcing a circuit component/metal coil into place to complete an electric circuit. Upon detection by the sensor circuit (or other insertion-sensing device), the controller operates to read static code in or on the body of the key to identify it (or determine its type/classification). The controller then operates one or more functional elements in or on the hilt body 310 to provide build-time functions or effects.

To this end, the body 310 of the hilt 300 is shown to include within (or immediately adjacent) a light source 415 in the form of an RGB LED, and the controller powers the RGB LED based on the identification/classification of the inserted key to illuminate the key, with white light and/or light matched to the key to achieve a desired output color(s). Other light sources may also be provided in the hilt assembly 400 to illuminate the hilt body 310 during build time (e.g., the key is typically inserted first or before the add-on parts 410, 412, 416, and 418 so the translucent body 310 of the hilt 300 can be caused to glow with the second light source not shown in FIGS. 3 and 4). Upon completion of the assembly—such as with proper attachment or coupling of the emitter 418 onto the hilt body 310, the controller operates to halt build-time functions such as by turning the light source 415 off and turning a sound system off or changing the sound file from a build-time sound file or soundtrack to a post build-time sound file or soundtrack.

Figure 5:
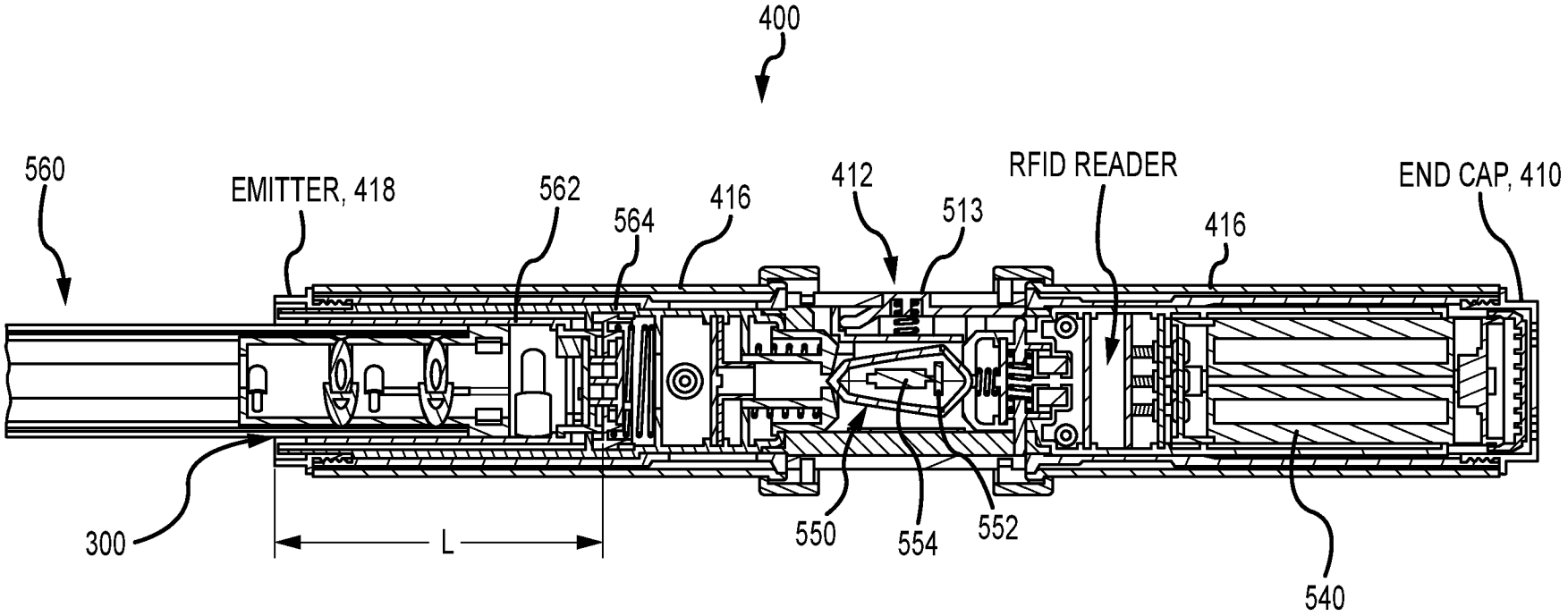
FIG. 5 is sectional view of the assembly of FIG. 4 after assembly is completed including insertion of the key and the light blade into the emitter end of the hilt/handle assembly.

FIG. 5 illustrates, with a cross sectional view, a completely assembled BYO toy using the hilt assembly 400 of FIG. 4. As shown, a lighted component 560 has been inserted into and coupled (e.g., with a threaded, snap, or friction fit connection) with the body 310 of the inner hilt 300 at the emitter or outer end 318. The end 562 of the lighted component 560 is passed through the center of the emitter 418 that has been attached to the hilt body 310 and extends into the hilt body 310 a predefined distance, L (such as 1 to 3 inches or more) to provide a structurally sound connection with the relatively long light blade 560. The end 562 of the blade 560, upon insertion as shown, is electrically coupled to power output connector 564 in the interior of the hilt body 310 so as to selectively (e.g., via operations of the BYO controller) provide power to light sources (e.g., an LED strip) in the blade 560. To this end, a power source 540 in the form of a battery is shown to be housed inside the body 310 of the inner hilt 300.

As shown, a data key 550 has been inserted by a build participant into the receptacle 314 of the inner hilt 300. When insertion is detected by a controller in the hilt body 310, the controller uses a sensor (e.g., an RFID reader) to read a code (static, dynamic, or programmable code or data) stored in a device (e.g., an RFID tag 552) in the body of the key 550. The controller uses this read data or static code to identify the key 550 and to retrieve a set of build-time functions or effects and to operate functional elements in or on the body 310 of the hilt 300 to provide the build-time functions or effects matched to the key 550. These may include operating the light source to cause the key 550 to glow (e.g., with a particular color or with a uniform color for all keys 550). The functions or effects may also include illuminating one or more other light sources in the hilt 300 to cause the hilt body 310 to glow in one or more colors matched to the ID of the key 550.

In some cases, a sound system in the hilt 300 will also be operated to play a sound file associated with build time and, in some cases, associated with the ID of the key 550. In some cases, the key 550 will include a data storage device 554 that can be read (e.g., in a wired or wireless manner) by the controller of the hilt assembly 400 to provide a sound track or clip to be played over the sound system of the inner hilt 300 during build-time (e.g., powering up sounds, narrative clips from a character encouraging the participant to complete the build, and so on). In other cases, though, the sound clips/files are stored in memory in the hilt 300.

Once assembly is completed and detected by the controller (such as by detection of proper attachment of the emitter 418), the controller may terminate the operations of the functional elements so as to halt build-time functions or effects, e.g., by blocking power to the light source illuminating the key 550 and turning off the sound system. The controller may then operate the functional elements and also provide power to the light blade or lighted component 560 (and control signals, in some cases, to use its RGB LEDs to provide a color selected based on the ID of the key 550) to provide post built-time functions and effects. These typically will differ at least in some manner from the build-time effects (e.g., not include lighting the key 550, include playing different sound files, include illuminating the blade or lighted component 560, and so on). The post build-time functions or effects may be initiated automatically by the controller in the hilt assembly 400 or may be initiated (or even chosen among two or more functions or effects) by the controller when a user provides user input via the user input device accessible through the switch 412. As shown, the switch 412 includes a button 513 that can be pressed to cause the controller to initiate post build-time functions or effects (e.g., to complete a circuit that can be sensed by the controller).

In general, a toy body or base part is provided in each embodiment, with a center hilt being just one useful example. The center hilt (or other toy body or base part) includes all electronics within its body including a power source (e.g., one to three or more batteries with one center hilt being configured for three AAA batteries). An RFID reader is provided inside to sense the key, which includes an RFID tag with a readable static code allowing the controller to determine the color and/or other information for build-time and post build-time effects (e.g., a character associated with the key that may change the sound files played over the sound system). The controller in the hilt changes the color of lights used to illuminate the hilt (and, in some cases, illuminate the key) during build-time and to illuminate the light blade or lighted component (additional add-on part) during post build-time operations.

The general build process involves: (a) once a key is chosen, inserting the key inside the center chamber area (or receptacle); (b) operating the LEDs on the topside of the hilt to change color to match the color of the key (or linked to the key ID or defined in the static code) and operating an additional LED inside the bottom of the key chamber to shine through the chamber to illuminate the inserted key to make it look "active;" (c) guiding the build participant to slide on their sleeve pieces (both for top and bottom parts/sleeves); (d) once sleeves are added, guiding the build participants to twist or screw on top emitter and bottom end caps so sleeve pieces do not slide off the hilt body; (e) guiding the build participants to add left and right chamber door or switch pieces (when a two-piece design is used for switch) to cover up the center key chamber area and then using the controller to turn off the LEDs inside the hilt body to end these build-time functions or special effects (when a one-piece design is used, the switch is slid over the hilt body after the first sleeve); (f) the build participants may then be encouraged to twist the top and bottom sleeves to connect with the center chamber doors (switch) to complete the hilt assembly build process and to hold all the hilt assembly pieces together tightly; and (g) once the hilt assembly is assembled, the build participants will be guided to insert the light blade into the top opening of the hilt body near the emitter and to operate the switch (e.g., slide up on center chamber door area to turn on the blade) to cause the controller in the hilt to communicate control signals (as well as power from the onboard batteries) to cause LEDs on the blade body to illuminate in the same color as the key inside the hilt (or in one or more colors linked to its ID or defined by the readable static code on the key).

Figure 6:
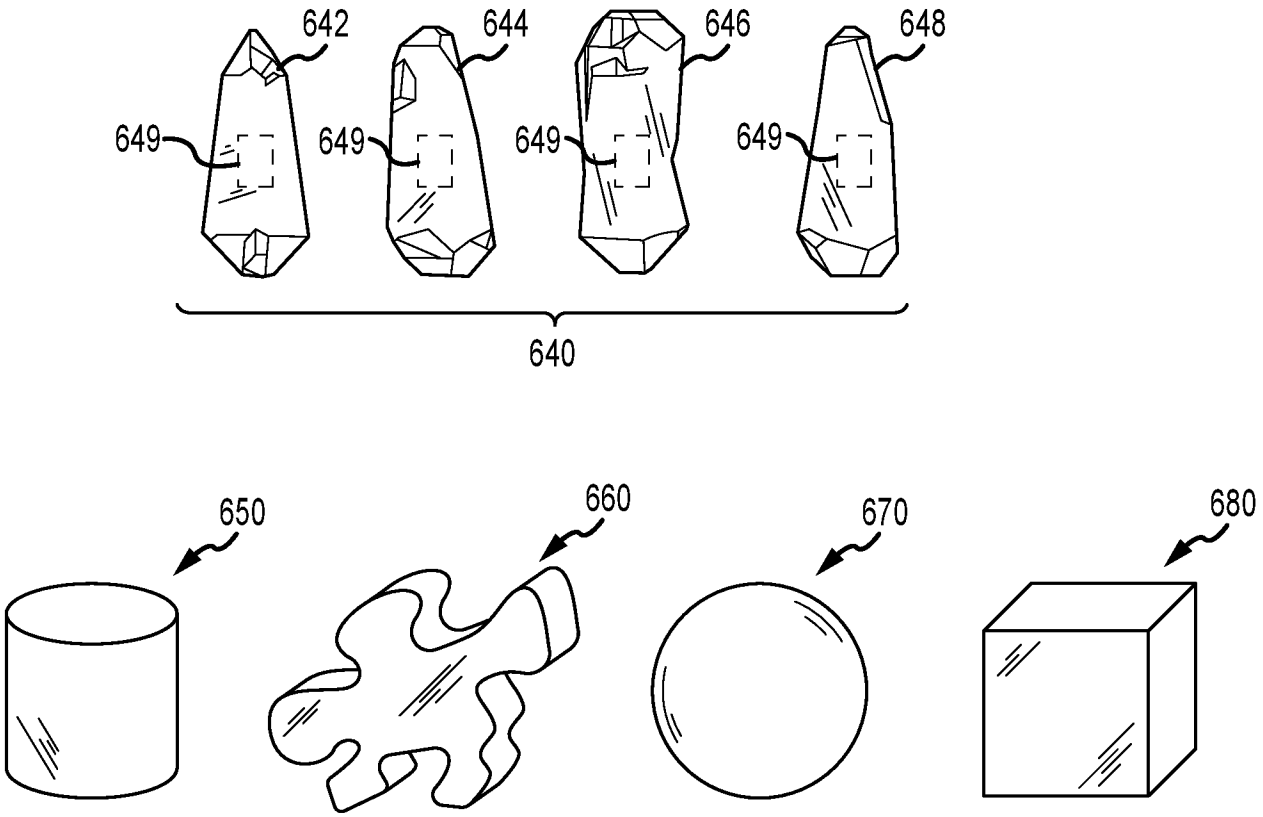
FIG. 6 is a side view of a plurality of keys that may be chosen by a build participant for use in driving or powering a BYO such as that shown in FIGS. 3-5.

In the BYO light sword and wand embodiments, a choice between numerous different data keys may be utilized and provided to the build participants to allow them to design and build their toy. In one planned embodiment, there are six different colors (e.g., purple, blue, green, red, white, and yellow but fewer or more colors may be utilized) for the participants to choose from as well as four different sculpts (or exterior surfaces) or designs that have a crystalline form. FIG. 6 illustrates a set 640 of four data keys with crystal shapes with all four of the differing sculpts 642, 644, 646, and 648. Each key 642, 644, 646, and 648 has its own unique preprogrammed RFID tag 649 inside its body (or otherwise positioned so not noticeable to a BYO toy participant) that tells different items within a build-time space and a post build-time space how to react (operate) when the toy or its hilt assembly with one of the data keys in the set 640 is in close proximity or contact (e.g., change colors of the lighted component and/or surrounding components/spaces, play different sounds or character sound files, and the like). The key may have nearly any desired form factor such as a cylinder key 650, a puzzle piece-shaped key 660, a spherical key 670, and/or a cube-shaped key 680.

Further, the data key may be used in a wide variety of other toys than the wands shown such as a plush toy, a robot toy, or nearly any other toy with functions that can be triggered and/or controlled as described herein. In some cases, a single data key can be used in a "holocron" to customize the special effects in that toy, which is essentially a toy that is an information storage device for storing messages such as a chronical, a logbook, and so on. The customization provided with the data key is similar to that explained for the wand-based toys, and the toy may be adapted to use the data key to trigger theme-appropriate audio and lighting.

Figure 7:
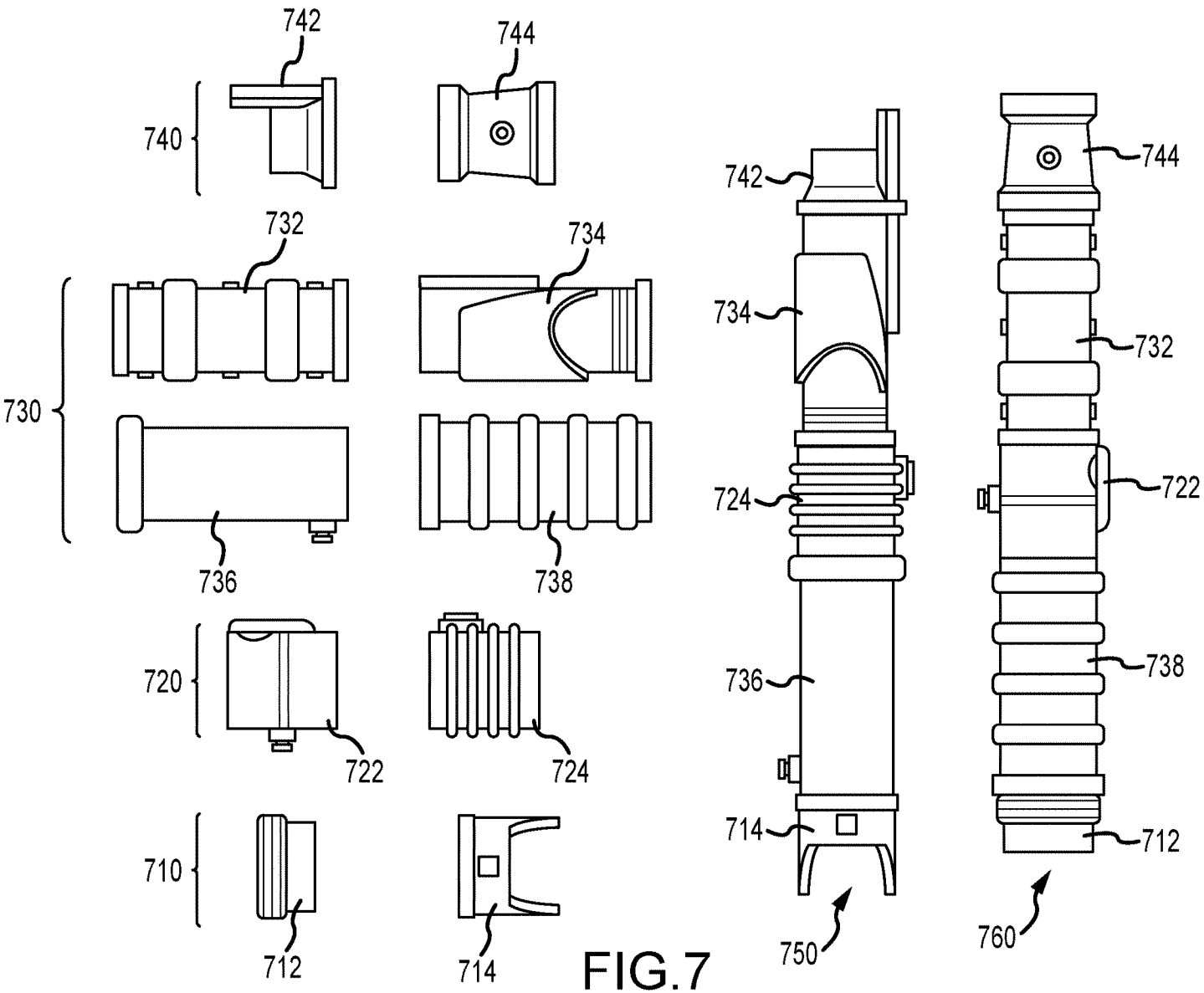
FIG. 7 is a side view of add-on components or accessories for a BYO toy of the present description and to assembled hilt or handle assemblies that may be built using these various components/accessories (along with an inner hilt or base part hidden from view upon assembly)

FIG. 7 illustrates one useful example of add-on parts or accessories that may be provided to a build participant to allow them to participate in a BYO toy experience, and this set may be chosen from two, three, four, or more such sets to allow a very large number of differently designed toys to be created. As shown, the set of add-on parts includes: a set 710 of two different endcaps 712, 714; a set 720 of two different one-piece switches 722, 724; a set 730 of four differently configured sleeves 732, 734, 736, and 738; and a set 740 of two different emitters 742, 744. FIG. 7 further shows a first hilt assembly 750 assembled from these add-on parts (e.g., upon a center hilt not shown), and the assembly 750 includes the end cap 714, the sleeve 736, and switch 724, and sleeve 734, and the emitter 742. A second hilt assembly 760 that differs from the first assembly 750 includes the end cap 712, the sleeve 738, the switch 722, the sleeve 732, and the emitter 744. As will be appreciated from this example, the BYO toy design of the present description allows build participants to design numerous differing toys by choosing differing add-on parts and arranging them in differing orders (such as the sleeves in some cases).

Figure 8A:
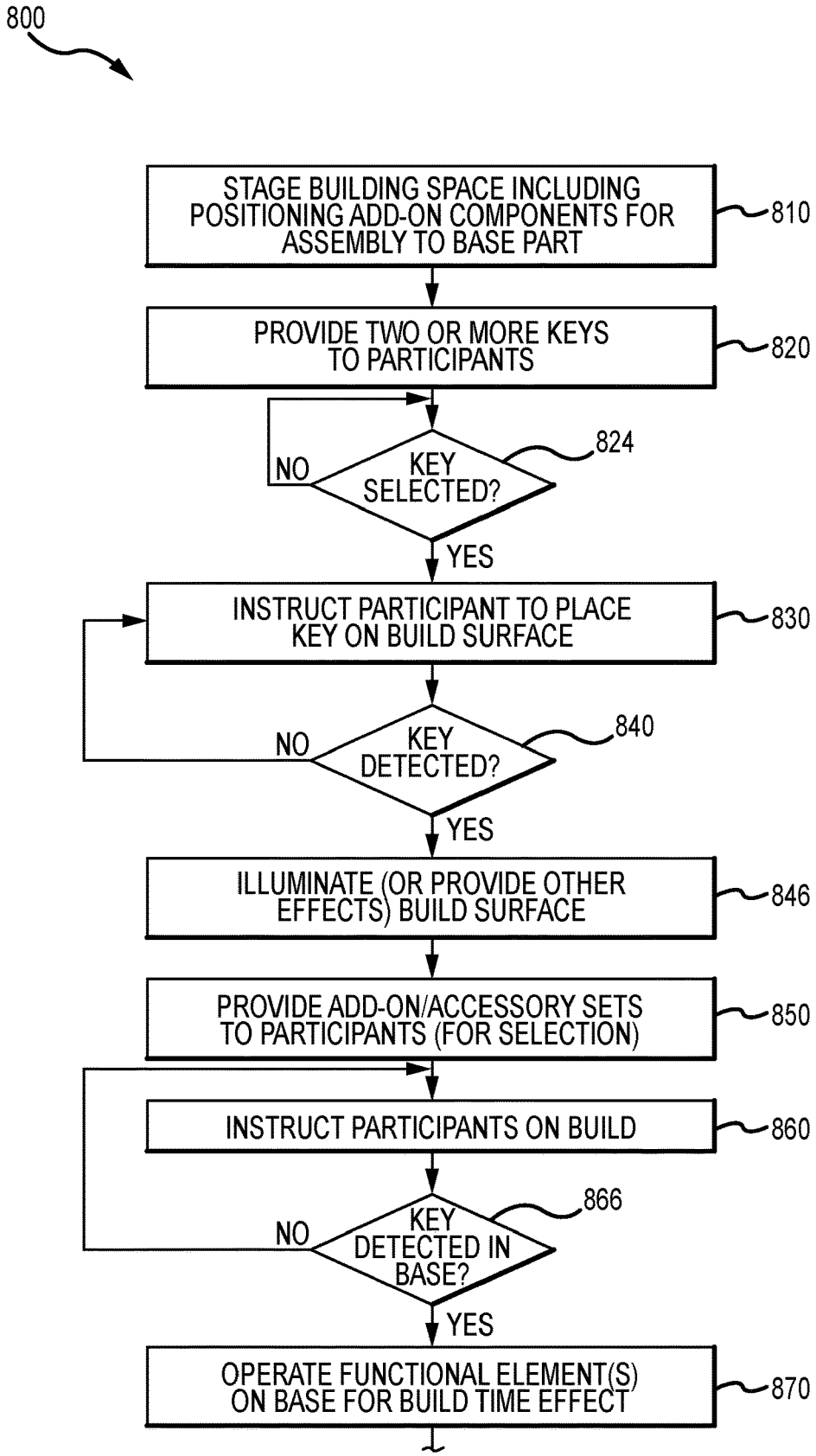
FIGS. 8A and 8B is a flow diagram of a toy build method of the present description such as may be used to build the BYO toys of FIGS. 1-7.
Figure 8B:
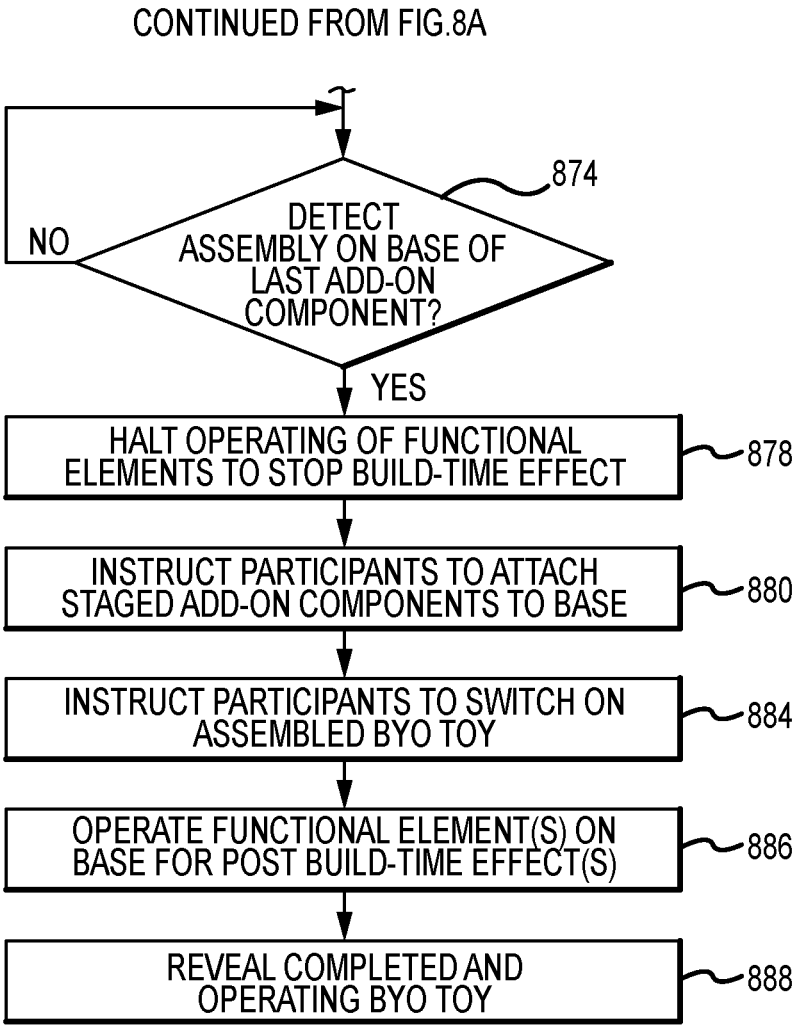

FIGS. 8A and 8B illustrate a BYO toy method 800 that may be implemented using the processes and components shown in FIG. 1 as well as the BYO toys of FIGS. 2-7. In step 810, the method 800 involves staging the facility space for a build-it-yourself experience, and this may include positioning add-on components in the space, placing a base part out for each participant, and concealing a final or additional add-on part that may be attached to the nearly-finished/assembled BYO toy in some cases (e.g., the lighted component in some particular embodiments as discussed above).

The method 800 continues with step 820 with a build leader or facilitator providing a plurality (two or more) of keys for the BYO toy to one, two, or more build participants in the staged facility. At 824, the method 800 involves determining whether or not each participant has selected a key. If not, the method 800 continues at 824. If yes, the method 800 continues at 830 with the build facilitator (which may be a wholly or partially automated system or device in some cases) instructing the participant(s) to place the key they selected on a build surface such as in a slot on a tray. At 840, the method 800 involves detecting or sensing when the key is properly positioned on the build surface. If not detected, the method 800 continues at 830. If detected in an expected slot/position, the method 800 continues at 846 with illuminating a build surface (such as with the color of the key or a color linked to its ID or readable static code) and/or providing other build-time effects (e.g., sound system operated to play a sound file that may be linked to the key sensed on the build surface or that may be more generic to the build experience).

The method 800 continues then at 850 with the facilitator providing the participant(s) with one or more sets of add-on parts or accessories. The participants are then at 860 instructed or guided on how to begin and complete assembly of the BYO toy, which may include instructing them to choose a particular number and type of the add-on parts/accessories. At step 866, the method 800 continues with a controller in each toy body or base part to detect when a participant has properly inserted a key into the receptacle/inner chamber of the base part/toy body. The build-time effect of illuminating the build tray/slot is often halted upon removal of the key from the build surface. If not detected at 866, step 860 is repeated. If yes, the method 800 continues at 870 with the controller operating one or more functional elements in the base part (e.g., inner hilt) to provide one or more build-time effects that can be chosen based on the ID or type of the key inserted and sensed or defined by (or linked to) static code read from the key (e.g., from an RFID tag on or in the key).

The method 800 continues at 874 with detecting when the participant has assembled a last add-on component, e.g., it has been attached to or coupled to the toy body/base part. If not, this step is repeated. Once detected, the method 800 continues at 878 with the controller halting operation of the functional elements to stop build-time effects (or switching or changing operation of these functional elements to different build-time effects). The method 800 continues at 880 with instructing participants to attach an add-on part that was revealed or otherwise staged in step 810, such as by threading an end of this part onto a threaded hole or post on the assembled toy. At step 884, the facilitator instructs participants to switch on their assembled BYO toy (operate a user I/O device such as an On/Off switch or the like). Then, at step 886, the method 800 involves operating (with the controller in the toy base) functional elements on the base part and/or on the component added in step 880 to provide post build-time effects. Step 888 is next performed to reveal to the participant(s), and allow full post build-time operations of, the assembled BYO toy. Step 888 may involve retracting or otherwise moving the build surface, a panel, a table top, and so on to show the part added in step 880, and this part may be illuminated (e.g., to a color matching or linked to the inserted key).

Figures 9A, 9B, 9C:
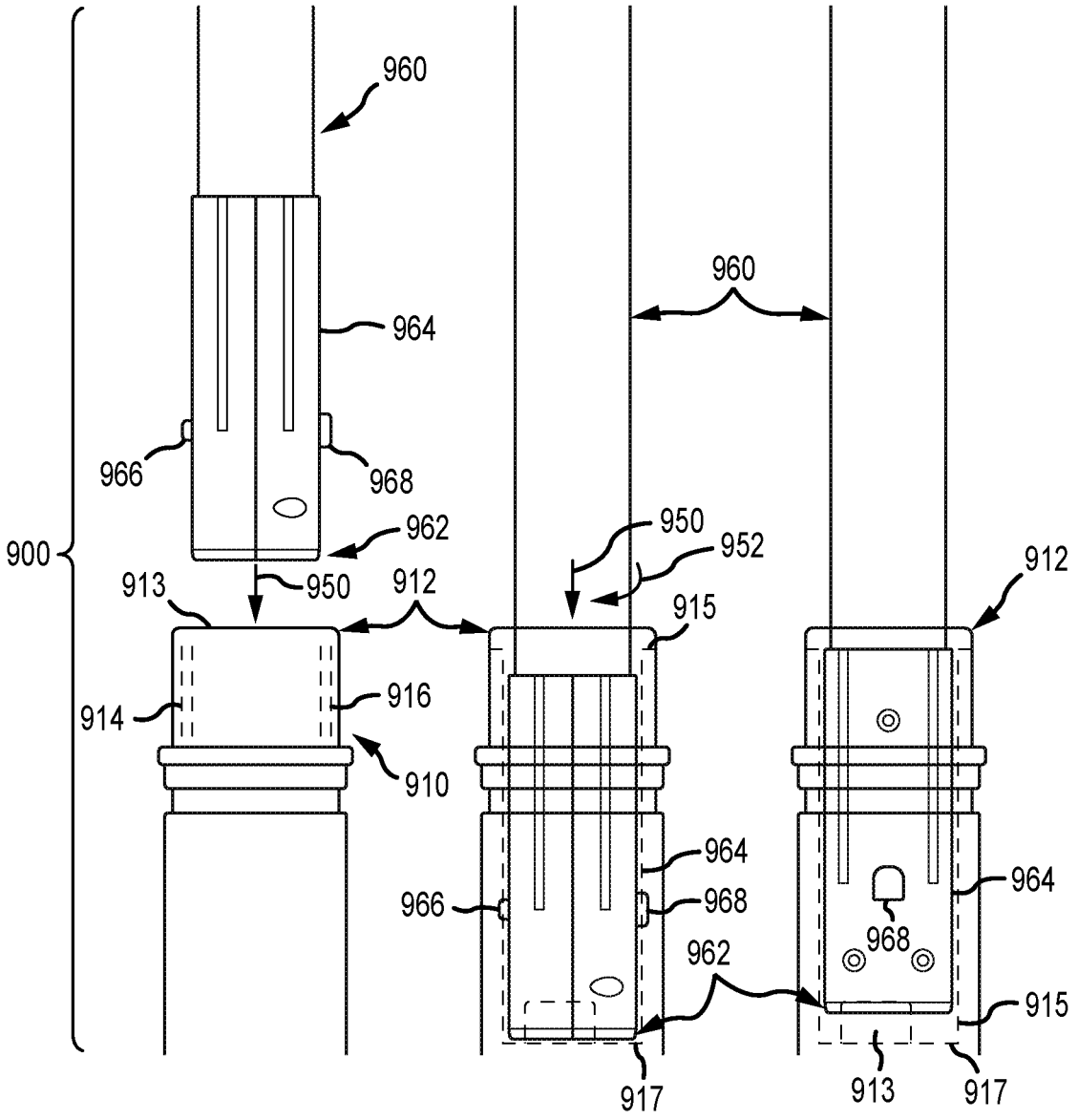
FIGS. 9A-9C illustrates a BYO toy during final assembly involving attachment (and later detachment) of the lighted component or light blade into the hilt assembly for proper mechanical retention and electrical connections.
Figure 10A:
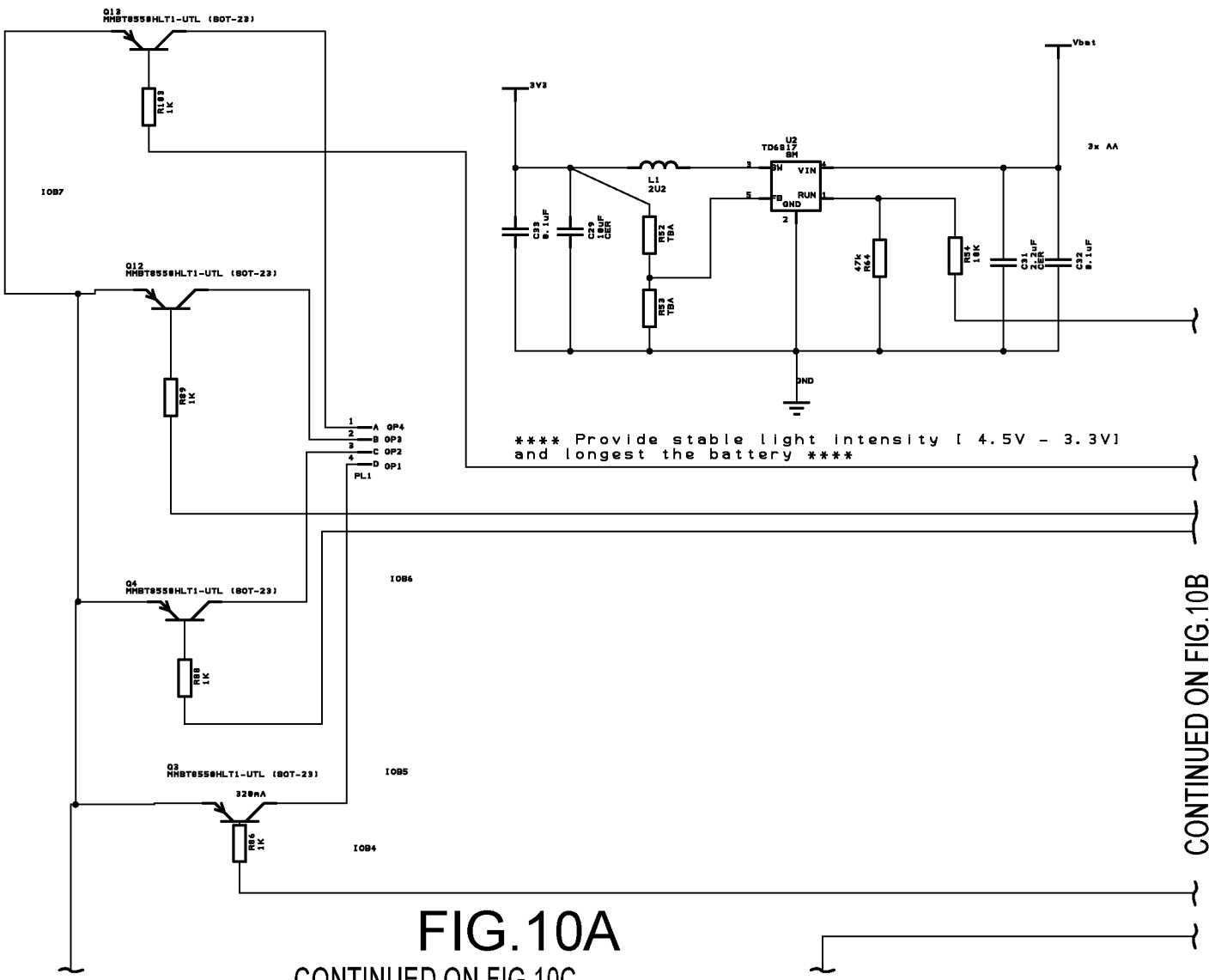
FIGS. 10A-10C illustrates an electrical schematic of one useful example of an assembled BYO toy (such as the assembled toy shown in FIG. 9C).
Figure 10B:
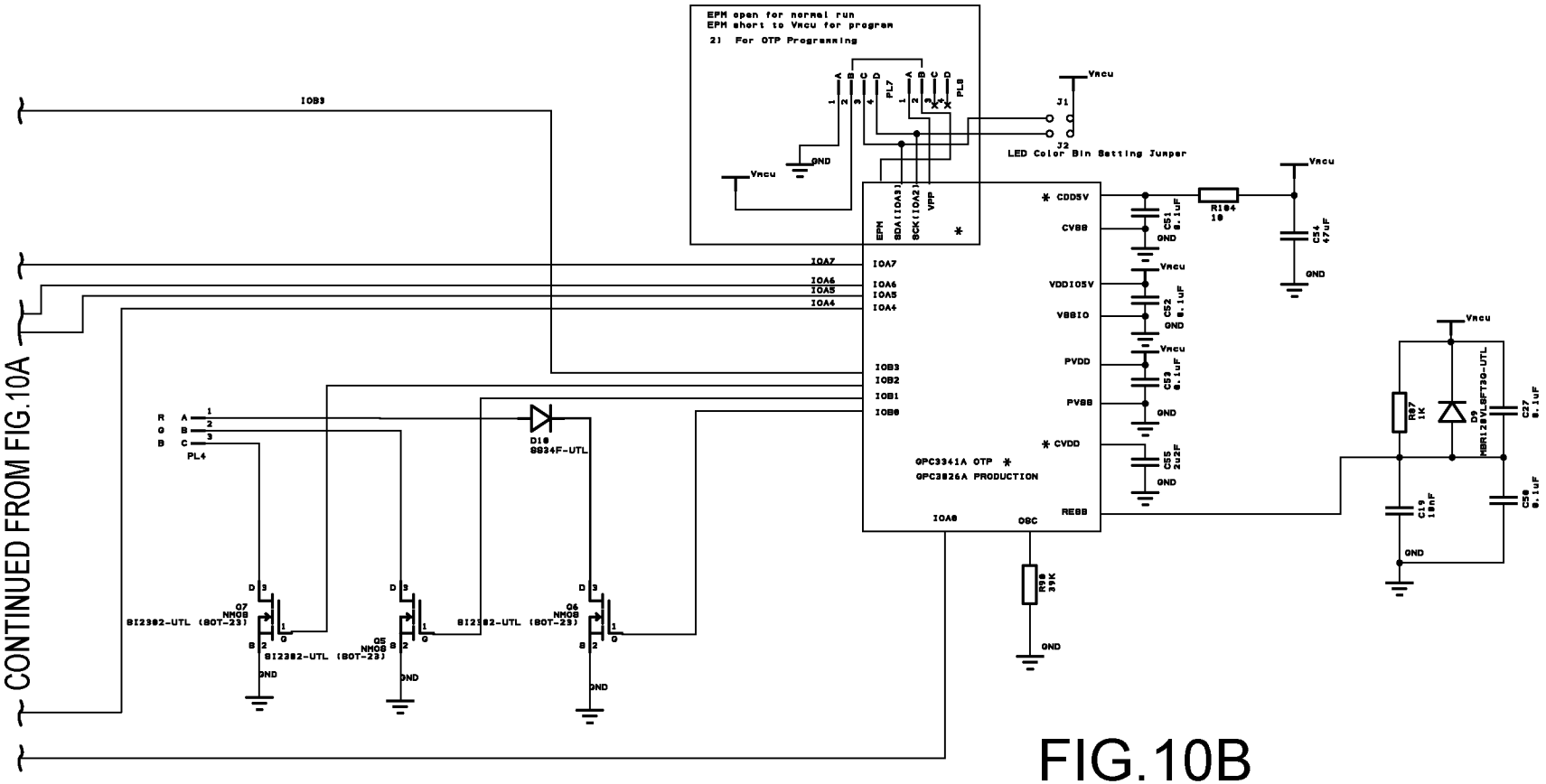
Figure 10C:
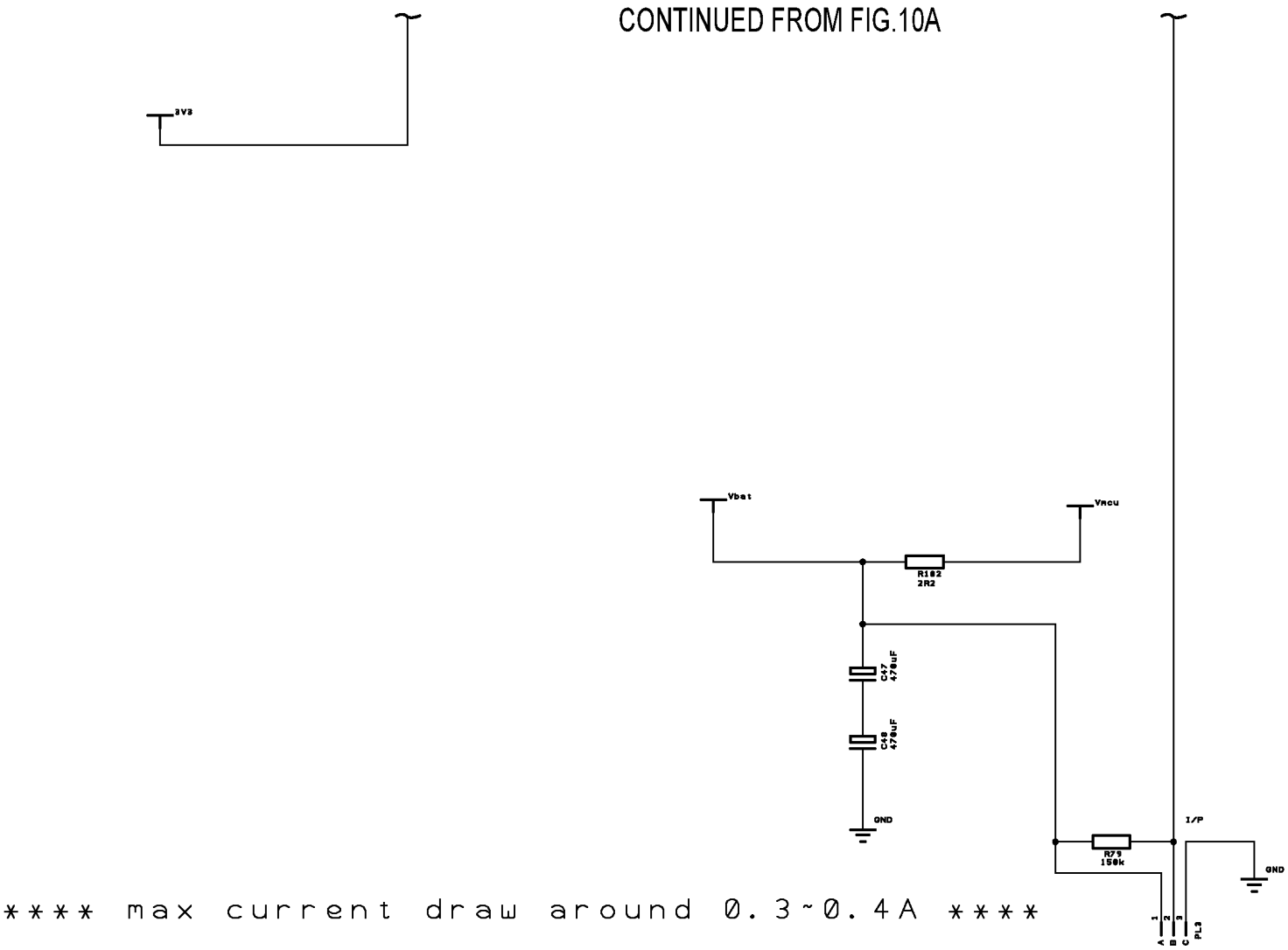

FIGS. 9A-9C illustrates a BYO toy 900 during final assembly involving attachment (and later detachment) of the lighted component or light blade 960 into an outer end 918 of a hilt body 910 of a hilt assembly of the present description for proper mechanical retention and electrical connection. FIGS. 10A-10C illustrate an electrical schematic 1000 of one useful example of an assembled BYO toy (such as the assembled toy 900 shown in FIG. 9C). FIG. 5 illustrated internal components of a hilt assembly 400 and showed the assembly 400 with a lighted component or light blade 560 after its insertion and electrical connection within the assembly 400. FIGS. 9A-9C provide one useful example of how mechanical and electrical interconnection between a hilt assembly and a light blade or lighted component may be usefully achieved.

In FIG. 9A, the BYO toy 900 is shown prior to coupling of a lighted component or light blade 960 with a hilt body 910 of a hilt assembly (any of those shown in prior description). As shown, the light blade 960 has an end cap or connector 964 mounted on or provided on/over an end 962. Outer surfaces of the end cap or connector 964 include one or more electrical connection elements so that the hilt assembly can be used to power and control light elements in the lighted blade 960 upon proper assembly, with electrical components and connections shown in detail in the schematic 1000 of FIG. 10. Mechanical coupling is furthered by the inclusion of a first key 966 and a second key 968 on opposite sides of the outer surfaces of the connector 964 proximate (e.g., within 0.5 to 2 inches) to the end 962.

The first and second keys 966 and 968 typically differ in size and/or shape such that the blade 960 can only be inserted into the hilt body 910 with a single orientation so that electrical connection components on the end connector 964 are properly aligned with and abutting corresponding electrical connection components within the hilt body 910. For example, the first key 966 may be smaller than the second key 968, such as a with a smaller outer diameter (when the key is circular in shape) or smaller outer width (and/or length) when a non-circular shape is used (e.g., see shape of key 968 shown in FIG. 9C). The keys 966 and 968 may extend outward from the outer surface of the end connector/cap 964 the same or differing amounts, with FIG. 9A showing a common height (e.g., 0.1 to 0.25 inches or the like), and this height may be selected to match a depth of the receiving grooves 914 and 916 in the hilt body 910 (e.g., a height that is a small amount less than the depth of the grooves 914 and 916 so that the keys 966, 968 can be fully received in the grooves 914, 916).

As shown, the hilt body 910 includes an opening (or has an aperture) at the outer end 912 to provide access to an interior space or recessed surface 913 for receiving the end 962 and connector 964 of the blade 960. As shown in FIG. 9B, the interior space 913 is defined by sidewall 915 (e.g., to define an outer diameter of a cylindrically-shape interior space 913 that is greater than an outer diameter of the connector/cap 964 on blade 960) to allow the blade 960 to be inserted into the hilt body 910 and by an end wall 917 (e.g., to define a length of the interior space 913 and to limit travel of the blade 960 after the entire connector/cap 964 is received in the interior space 913). At opposite locations about the periphery of the interior space 913, the sidewall 915 includes first and second grooves 914, 916 that are open at or begin at the end 912. The first groove 914 is adapted to receive the first key 966 and has a size (e.g., width and depth) matching that of the first key 966 (e.g., slightly larger in width and depth than the first key 966) so that it can receive the first key 966 during insertion (as shown with arrow 950) of the blade end 962 into the interior space 913 of the hilt body 910. Similarly, the second groove 916 is adapted to receive the second key 968 and has a size (e.g., width and depth) matching that of the second key 968 (e.g., slightly larger in width and depth than the second key 968) so that it can receive the second key 968 during insertion (as shown with arrow 950) of the blade end 962 into the interior space 913 of the hilt body 910. The grooves 914 and 916 extend the length of the interior space 913 (or at least to a depth that allows the keys 966 and 968 to be guided within them until the end 962 abuts the end wall 917).

As an initial assembly step as shown in FIG. 9A, a toy builder aligns the keys 966 and 968 on the sides of the lower blade 960 with exposed ends of grooves 914 and 916 respectively of hilt body 910. The blade 960 can be inserted, as shown with arrow 950, into the space 913 with the keys 966 and 968 sliding within the grooves 914 and 916. The blade 960 can only be inserted 950 in one orientation. FIG. 9B shows the BYO toy 900 in a later stage of assembly. Particularly, the blade 960 is pushed all the way down into the interior space 913 such that the end 962 comes into abutting contact with the end wall 917 defining the interior space 913 of the hilt body 910. The builder/operator then rotates as shown with arrow 952 the blade 960 (clockwise as shown or counterclockwise in other embodiments) to lock the blade 960 in place. For example, the keys 966, 968 may rotate laterally or about the periphery of the interior space 913 in an additional groove (grooves) in the side wall 915 until a recess or notch is mated with the keys 966, 968. In some cases, the hilt body will make a sound to indicate successful connection. As shown in FIG. 9C, the BYO toy 900 is shown in a final assembly stage in which the blade 960 raises slightly (moves backward out of the interior space 913 of the hilt body 910 in a linear manner such as 0.05 to 0.25 inches) as it is locked in place. The builder/operator may push the blade further into the hilt body 910 and rotate 952 the blade 960 in the opposite direction (counterclockwise or clockwise 90 degrees or some other amount of rotation) to unlock the blade 960 and allow its removal from space 913 of the hilt body 910.

Although the invention has been described and illustrated with a certain degree of particularity, the particular implementations described in the present disclosure have been as examples, and numerous changes in the combination and arrangement of parts can be resorted to by those skilled in the art without departing from the spirit and scope of the invention, as claimed.

We claim:

1. A set of toys, comprising:

two or more toys each comprising:

a body with an interface;

a controller provided in the body;

an effects assembly on or in the body and coupled to the controller such that the controller can operate a plurality of functions of the effects assembly;

a data key holding theme data for driving operations of the toy; and a receptacle configured to hold the data key, wherein the data key is interchangeable for use in all of the two or more toys, wherein the controller of each of the two or more toys includes a sensor sensing when the data key is positioned in the receptacle, wherein the controller of each of the two or more toys, in response to the sensor sensing the data key has been received in the receptacle, selects a subset of the plurality of functions and operates the effects assembly to implement the subset of the plurality of functions and to produce an effect based on the theme data, and wherein the effect produced by the controller in a first of the two or more toys is distinct from the effect produced by the controller in a second of the two or more toys.

2. The set of toys of claim 1, wherein the effects assembly in each of the two or more toys is a lighting assembly operated by the controller to illuminate the data key with light of a color matching a color of the data key or a color selected from a plurality of colors based on an identification of the data key.

3. The set of toys of claim 1, wherein the identification of the data key is stored in a set of readable, static code on the data key, wherein the controller includes a reader reading the readable, static code.

4. The set of toys of claim 3, wherein the data key includes an RFID tag including the readable, static code and the controller further comprises an RFID reader for reading the RFID tag.

5. The set of toys of claim 1, wherein the body of each of the two or more toys further includes a sound system and wherein the controller operates the sound system to play a sound file over a speaker of the sound system.

6. The set of toys of claim 5, wherein the sound file is selected by the controller from memory on the body based on the identification of the data key.

7. A set of toys, comprising:

two or more toys each comprising:

a body with an interface;

a controller provided in the body;

an effects assembly on or in the body;

a data key holding theme data for driving operations of the toy; and a receptacle configured to hold the data key, wherein the data key is interchangeable for use in all of the two or more toys, wherein the controller of each of the two or more toys includes a sensor sensing when the data key is positioned in the receptacle, wherein the controller of each of the two or more toys, in response to the sensor sensing the data key has been received in the receptacle, operates the effects assembly to produce an effect based on the theme data, wherein the effect produced by the controller in a first of the two or more toys is distinct from the effect produced by the controller in a second of the two or more toys, and wherein the controller of each of the two or more toys operates a light source in an additional add-on part attached to the body, after the sensing of the completion of assembly of the additional add-on part to the body, to illuminate the additional add-on part with colored light selected based on a color or type of the data key, the theme data, or an identification of the data key.

8. The set of toys of claim 7, wherein the effects assembly in each of the two or more toys is a lighting assembly operated by the controller to illuminate the data key or the body with light of a color matching a color of the data key or selected from a plurality of colors based on the identification of the data key.

9. The set of toys of claim 8, wherein the identification of the data key is stored in a set of readable, static code on the data key, wherein the controller includes a reader reading the readable, static code.

10. The set of toys of claim 9, wherein the data key includes an RFID tag including the readable, static code and the controller further comprises an RFID reader for reading the RFID tag.

11. The set of toys of claim 7, wherein the body of each of the two or more toys further includes a sound system and wherein the controller operates the sound system to play a sound file over a speaker of the sound system.

12. The set of toys of claim 11, wherein the sound file is selected by the controller from memory on the body based on the identification of the data key.

13. A set of toys, comprising:

a set of data defined for operating the set of toys; and two or more toys each comprising:

a body with an interface;

a controller provided in the body;

an effects assembly on or in the body;

a data key holding the set of data; and a set of add-on parts configured to be assembled with the body, wherein the controller of each of the two or more toys includes a sensor sensing when the data key is coupled to the interface, wherein the controller of each of the two or more toys, in response to the sensor sensing the data key has been coupled to the interface, to operate the effects assembly to produce an effect based on the set of data, and wherein the controller of each of the two or more toys operates a light source in one of the set of add-on parts attached to the body, after the sensing of the completion of assembly of the one of set of add-on parts to the body, to illuminate the one of the set of add-on parts with colored light selected based on a color or a type of the data key.

14. The set of toys of claim 13, wherein the effects assembly comprises a lighting assembly operated by the controller to provide the effect including illuminating the data key or the body.

15. The set of toys of claim 14, wherein the lighting assembly of each of the two or more toys is operated by the controller to illuminate the data key or the body with light of a color matching a color of the data key or selected from a plurality of colors based on an identification of the data key.

16. The set of toys of claim 15, wherein the identification of the data key is stored in a set of readable, static code on the data key, wherein the controller includes a reader reading the readable, static code, and wherein the data key includes an RFID tag including the readable, static code and the controller further comprises an RFID reader for reading the RFID tag.

17. The set of toys of claim 16, wherein the body of each of the two or more toys further includes a sound system, wherein the controller operates the sound system to play a sound file over a speaker of the sound system, and wherein the sound file is selected by the controller from memory on the body based on the identification of the data key.

18. The set of toys of claim 13, wherein the effect generated by the effects assembly of each of the two or more toys differs for a first one and a second one of the two or more toys.

* * * * *